US007375299B1

(12) United States Patent
Pudney

(10) Patent No.: US 7,375,299 B1
(45) Date of Patent: May 20, 2008

(54) DOOR HANDLE

(75) Inventor: Richard I. Pudney, Plymouth, MI (US)

(73) Assignee: Key Plastics, LLC, Northville, MI (US)

( * ) Notice: Subject to any disclaimer, the term of this patent is extended or adjusted under 35 U.S.C. 154(b) by 0 days.

(21) Appl. No.: 11/781,559

(22) Filed: Jul. 23, 2007

(51) Int. Cl.
*H01H 3/16* (2006.01)

(52) U.S. Cl. ..... 200/61.62

(58) Field of Classification Search ..... 200/61.62; 292/347, 336.3; 340/5.72, 5.62, 568.5, 522, 340/426, 539, 573.1, 825.31, 825.34, 825.69; 343/872; 180/287; 70/237, 255, 258; 307/9.1, 307/10.1

See application file for complete search history.

(56) References Cited

U.S. PATENT DOCUMENTS 6,696,652 B1 * 2/2004 Spies ..... 200/61.62
6,768,413 B1 * 7/2004 Kemmann et al. ..... 340/5.72
6,933,831 B2 * 8/2005 Ieda et al. ..... 340/5.72
7,019,233 B2 * 3/2006 Spies ..... 200/61.62
7,057,124 B2 * 6/2006 Ieda et al. ..... 200/61.62
7,078,640 B2 * 7/2006 Miyake et al. ..... 200/341
7,140,653 B2 * 11/2006 Kobayashi et al. ..... 292/348
7,173,346 B2 * 2/2007 Aiyama et al. ..... 307/9.1
7,199,317 B2 * 4/2007 Ieda et al. ..... 200/61.62
7,210,715 B2 * 5/2007 Kobayashi et al. ..... 292/336.3
7,273,991 B2 * 9/2007 Korultay et al. ..... 200/61.62
7,284,776 B2 * 10/2007 Cummins et al. ..... 292/336.3

* cited by examiner

*Primary Examiner*—Michael A Friedhofer
(74) *Attorney, Agent, or Firm*—David L King; Markell Seitzman

(57) ABSTRACT

A handle 16 for exterior use in a vehicle to authorize a mechanism (18) to unlatch an access door has a structural part (34); a cover (36); and a pair of sensors or switches (28, 29) between the structural part (34) and the cover (36). A first sensor or switch (28) to interact with one or more fingers of a user's (26) hand (2) and a second sensor or switch (29) spaced from said first sensor (28) to be activated by a user's (26) different finger or the user's (26) thumb. The combination of the two switches or sensors (28, 29) signal the mechanism (18) to unlatch the access door and wherein the activation of only the second sensor or switch (29) in the absence of touching the first sensor or switch (28) authorizes a mechanism (18) to lock the access door. Preferably, the first and second sensors or switches (28, 29) are electrically coupled such that activation of both authorizes an unlatching of the access door while the activation of only the second sensor or switch (29) authorizes a lock only feature. Accordingly, the second sensor or switch (29) changes authorization from unlatch to lock dependent on the use or non-use of the first sensor or switch (28).

11 Claims, 4 Drawing Sheets

DOOR HANDLE

FIELD OF THE INVENTION

The present invention generally relates to a semi-automatic system for unlatching vehicle doors, hatches, trunks, liftgates and other entryways. More particularly to a system that is more user-friendly than currently available systems.

BACKGROUND OF THE INVENTION

The present invention is useful in the automotive arts; however, it is generally applicable to any type of door, liftgate or window. By way of background, a number of functions or processes are needed to open a door. Consider a typical automotive door that is closed and one that has been locked, for example by sensing the presence of a certain type of passive sensor, manually activating a keyfob, pressing a button or manually with a key. To move this door from its closed position within its frame to an open position the door must be moved from a locked condition to an unlocked condition. As can be appreciated, in these orientations the door is still fixed to its frame and in a closed position. The second function that needs to be accomplished is to disengage the door's latching mechanism, to unlatch the door and, finally, the door needs to be moved from its closed position to an open position. The physical act of opening the door can be done manually or by an automated system as found in may vans and SUV's.

One basic problem with these fairly new automatic locking/unlocking and latching/unlatching systems is the degree of frustration they create in the user. For example, the person approaching the door for the purpose of opening the door and gaining entry into the vehicle is never certain of the lock/unlock/latch/unlatch state of the door. More often than not, the user will attempt to open the door that he or she believes to be unlocked only to find that the automatic system has once again failed, in the context of not placing the door in the physical state that is desired by the user. These deficiencies are solved by the present invention while still providing the desired security and safety of conventional door locking and latching mechanisms.

In US Patent Publication 2003/0216817 published on Nov. 20, 2003, a vehicle access system was proposed that provided a sensor positioned between a structural part and a cover of a handle wherein the user's interaction with the handle authorized the part to be unlatched. The handle in the preferred embodiment was rigidly attached and non-moveable, eliminating the need for most if not all of the mechanical components commonly associated with conventional mechanical latching mechanisms.

While a vast improvement over the more conventional systems, this handle still provided the same problem of identifying the status of the lock/unlock condition and therefore, similar to the prior art devices, the ability to unlatch the door is still dependent on the locked/unlocked status of the door.

The present invention provides a clever and genuinely simple way in which the user can insure the status of an access door, window or a trunk lid is in an unlatch mode as opposed to a lock/unlock mode as he attempts to open the door, window or lid.

SUMMARY OF THE INVENTION

A handle for exterior use in a vehicle to authorize a mechanism to unlatch an access door has a structural part; a cover; and a pair of sensors or switches between the structural part and the cover. A first sensor or switch to interact with one or more fingers of a user's hand and a second sensor or switch spaced from said first sensor to be activated by a user's different finger or the user's thumb. The combination of the two switches or sensors signal the mechanism to unlatch the access door and wherein the activation of only the second sensor or switch in the absence of touching the first sensor or switch authorizes a mechanism to lock the access door. Preferably, the first and second sensors or switches are electrically coupled such that activation of both authorizes an unlatching of the access door while the activation of only the second sensor or switch authorizes a lock only feature. Accordingly, the second sensor or switch changes authorization from unlatch to lock dependent on the use or non-use of the first sensor or switch.

The structural part can be formed as a bump or depression in an exterior surface of the access door. Preferably at least the structural part is rigid and non-moveable, more preferably the entire handle is rigidly and non-moveably attached or otherwise secured to the access door.

DETAILED DESCRIPTION OF THE INVENTION

It is to be understood the present invention may be embodied in other specific forms without departing from the scope of the invention. The illustrated and described embodiments are to be considered in all respects only as illustrative and not restrictive. The scope of the invention is, therefore, indicated by the appended claims rather than by the description. All changes that come within the meaning and range of equivalency of the claims and included elements are to be embraced within their scope.

Figure 1:
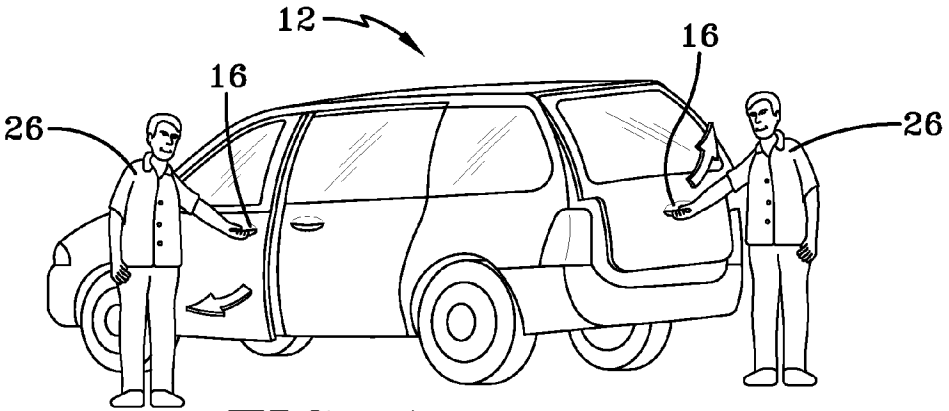
FIG. 1 is a perspective view of an exemplary vehicle employing a system arrangement according to an embodiment of the present invention.
Figure 2:
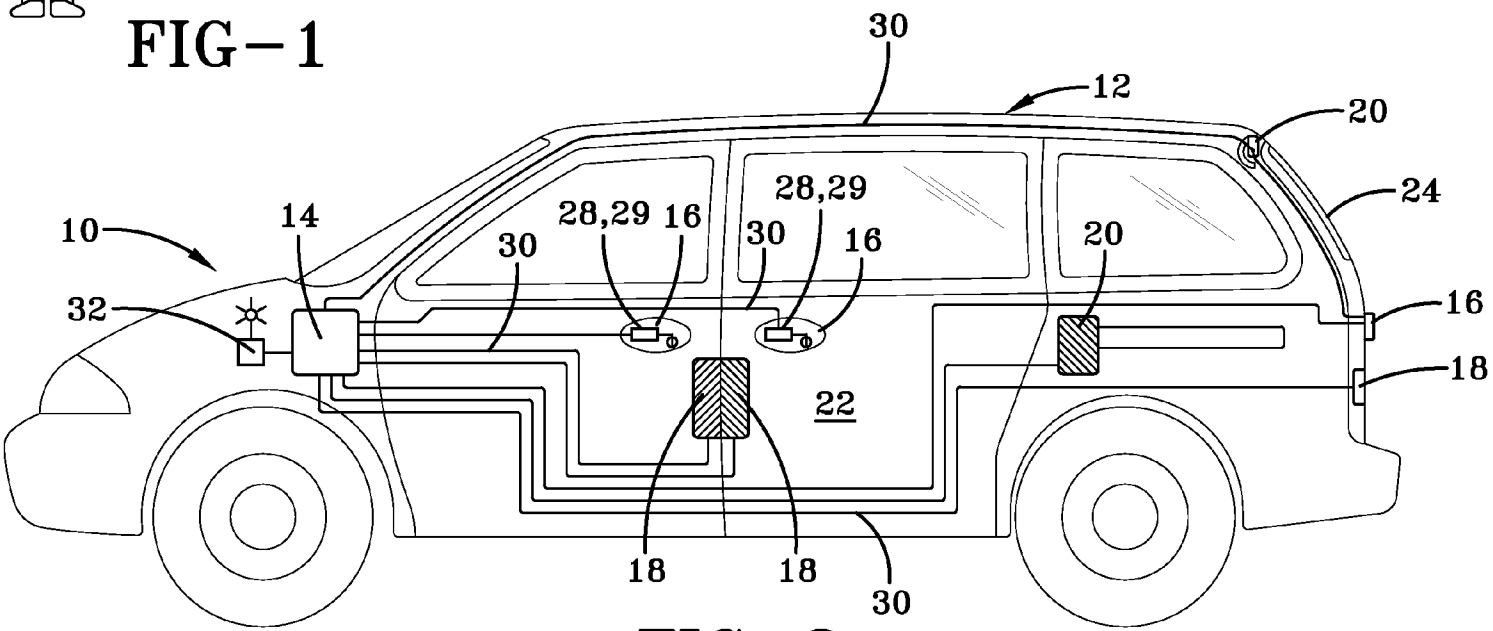
FIG. 2 is schematic of a side view of the vehicle of FIG. 1, showing an exemplary control circuit according to an embodiment of the present invention.

Referring now to FIGS. 1 and 2, an embodiment of the present invention is shown and described. The invention includes, among other things, a system arrangement 10 that is suitable for use in a vehicle 12 to facilitate opening or unlatching of various access doors, including without limitation, vehicle doors, liftgates, panels, trunk lids, hoods or other points of access. System 10 can be used for example, without limitation, in connection with trunk latches, flipglass latches and vehicle door latches to release the corresponding component to be opened. Such latches may also include other types of vehicle entry/exit mechanisms, for example, those mechanisms associated with power sliding doors and/or liftgate doors.

In one embodiment shown in FIG. 2, system 10 includes a control circuit having a controller 14, (shown in FIG. 2 in the form of a central processing unit or CPU) and one or more handles 16 that facilitate opening of a vehicle panel. The term "vehicle component" as used herein is meant to describe a wide variety of parts or components, including, without limitation, handles or emblems, that are designed to be held, grasped, touched or otherwise interacted with by a user. In the illustrated embodiments of system 10, controller 14 can operate one or more functions, including latching/unlatching the vehicle doors, trunk lid and other access doors to open or release the access door to be accessed or opened. When so configured, each access point door includes a latch mechanism 18 that is in operable connection with the access point door to effectuate opening of or access to the access door in response to a controller output. Optionally, one or more of the vehicle doors, trunk lid or other access door may include an opening assist mechanism 20 (e.g., a leverage-based device or an automatic gas-assist mechanism) that opens or helps open the respective access door with or without the assistance of a user.

In another embodiment, each latch mechanism 18 is an electronically or electrically-activated latch. Such a latch is known in the art and can be designed or set to unlatch when a signal from an associated system component is received. The associated system component may be a logic device such as microchip within or otherwise in communication with the handle or a controller for one or more functions, such as the controller identified as element 14. Each latch 18 is selectively operable in response to a user request to unlatch a corresponding access door to be opened under the user's power and/or under the power of opening assist mechanism 20. In the illustrative configuration shown in FIG. 2, a sliding side door 22 includes an opening assist mechanism 20, such as a motor driven mechanism, to slide side door 22 horizontally. Similarly, the rear door or liftgate 24 includes an opening assist mechanism 20 to open liftgate 24 vertically about a hinge. Opening assist mechanisms 20, such as those employed in vehicle 12, are also known in the art.

FIG. 1 shows a fairly generic representative vehicle 12 employing system 10 (such as in FIG. 2) in which a user 26 or a portion of the user (e.g., a hand) contacts or otherwise interacts (e.g., entering into a defined proximity range) with a handle feature or "handle" 16. A control unit or CPU, hereinafter referred to as controller 14, is in communication with the handle 16 and can respond to the user's interaction with handle 16 by operating the system 10 in a predetermined manner. For example, controller 14 may operate the front driver-side entry door latch mechanism 18 to release or unlatch the door to be opened in response to a user touching or grasping the door handle 16, for example, as shown in FIG. 1. In another example, controller 14 may operate the associated rear liftgate latch mechanism 18 to release the liftgate to be opened in response to the user touching a rear latch handle or other formation (e.g., an emblem), such as generally shown in FIG. 1.

In one embodiment, handle 16 includes a pair of sensors or switches 28, 29 for "sensing" the user's interaction with handle 16 and communicates this interaction with controller 14. Among other things, the user's interaction with handle 16 can be interpreted by controller 14 as a request to operate latch mechanism 18 to unlatch a corresponding access door and/or to activate opening assist mechanism 20 if so configured. Alternatively, the handle 16 may have one or more sensors wired directly to the latch mechanism 18 wherein a simultaneous interaction of the hand with the pair of sensors or switches 28, 29 which signals to latch mechanism directly.

In an embodiment of the invention, controller 14 is provided in communication with one or more of the various components of system 10 (e.g. handle 16, latch mechanism 18 and opening assist mechanism 20) through one or more wires 30 or other physical connections 43. However, a suitable wireless communication interface may also be employed by the system 10 (either as an addition or substitution for "hard-wiring") to provide a means for communication (e.g., input or signal) between a controller 14 with the various components of system 10. Alternatively, separate controllers may be placed into separate or individual communication with each component. System 10 may also include a wireless transmitter/receiver 32 in communication with controller 14, the use of which will be referred to in further detail below.

Figure 4:
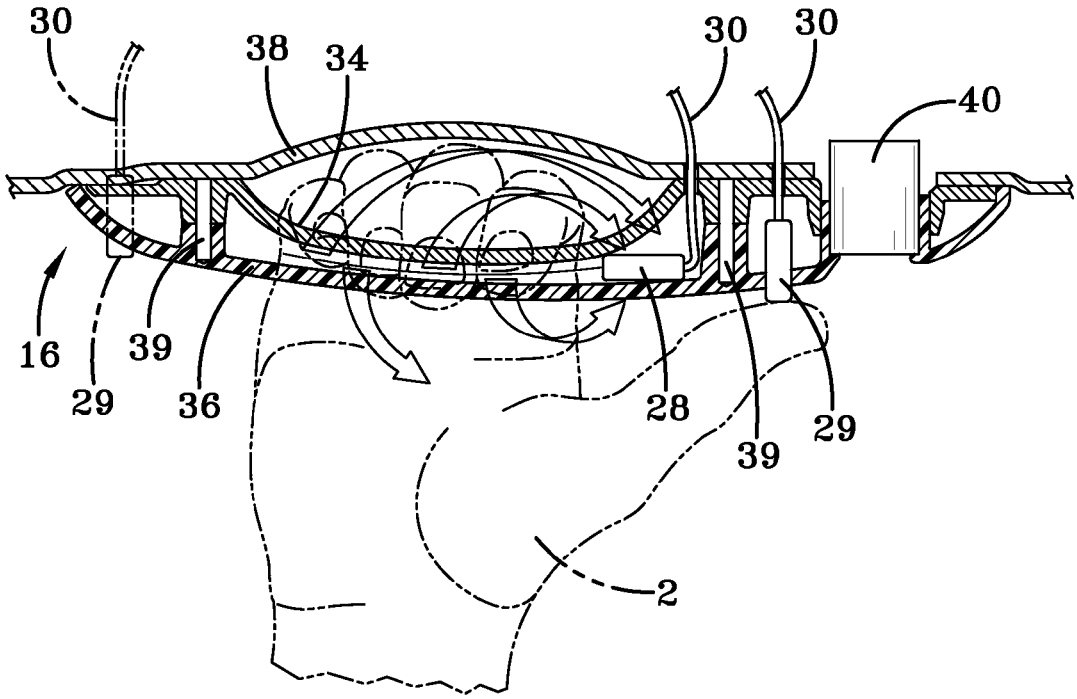
FIG. 4 is a cross-sectional view of a handle according to an embodiment of the invention.

Referring to FIG. 4, an embodiment of a handle 16 is disclosed, in which the handle 16 is ridged and/or non-movably secured to vehicle 12 and does not require moving parts, such as hinges or mechanical levers. In such an embodiment, the position and orientation of the handle remains substantially constant relative to an access door and merely provides a grip or rigid feature attached or affixed to an access door to facilitate the opening of the access door. In the illustrated embodiment, handle 16 includes, without limitation, three main components: a structural part 34, a decorative cover 36 and a pair of sensors or switches 28, 29. Sensors or switches 28, 29 can be positioned or packaged between structural part 34 and decorative cover 36, thus enclosing or "embedding" the sensor in the handle assembly. However, this is not the only way in which sensors or switches 28, 29 can be included for use in connection with handle 16 or the only structural design or configuration for the handle. If desired, the sensor or switch 28, 29 can be insert-molded into a one-piece handle 16 or the structural component 34 could also be the decorative part and the cover 36 could be simply a cover to house the sensor on the non-visible surface of the handle (e.g., like a battery cover on a toy).

Handle 16 may also have other components, including, among other things, decorative gaskets or functional gaskets, which can serve to isolate handle 16 from the corresponding access door 38 or other component of the vehicle. Handle 16 can also include a connector or connective material, such as some type of foam or tape to secure the sensor in place. There are a number of ways to secure handle pieces together: the parts may be snapped, glued, screwed, heat staked, welded or a combination of those or other conventional methods. For example, in an embodiment, a screw 39 or other fastener may be used to secure cover 36 to structural part 34 and/or handle 16 to the corresponding access door 38. In another example, portions of two parts 34, 36 may be snapped or otherwise adhered together while using an expanding foam or liquid rubber/adhesive to provide a more robust feel and make dust proof and/or water resistant.

Handle 16 may also be configured to permit someone to snap or otherwise connect a cover 36 of the user's choice. For example, a user could connect a decorative cover 36 of their own selection and easily replace the same as they desire. As will also be appreciated, handle 16 can be manufactured in many colors and ornamental designs to complement the user's personal style or the vehicle decor.

Referring still to FIG. 4, if desired, a key cylinder 40 (including conventional key cylinders) can be used in connection with the present concept to generally serve as a mechanical back-up for entry. In a particular embodiment, handle 16 can be designed to include a cooperative integral key cylinder 40, thus allowing the key cylinder 40 to be packaged in the handle 16. Such an embodiment could effectively have the key cylinder 40 packed or packaged into a handle 16. That option may be preferred in some applications because, among other things, the associated access door component 38, such as the door sheet metal, would not need to be configured to house the key cylinder 40.

With particular reference to FIG. 4, the handle 16 preferably includes two sensors, a first sensor 28 is responsive to the presence or touch of at least one or several fingers of the users hand 2. As these fingers touch or otherwise interact with the sensor or switch 28 nothing happens other than the sensor or switch is activated or otherwise armed. As the user touches or otherwise interacts with the spaced apart second sensor or switch 29 with another finger or preferably a thumb that sensor or switch 29 is also activated. When both sensors or switches 28, 29 are activated, a signal is sent to either the controller 14 or directly to the latch mechanism 18 to unlatch the access door. In this way an inadvertent unlatch signal is avoided, as to create an unlatch signal, two distinct interactions with both of the spaced apart sensors or switches 28 and 29 must simultaneously occur. Historically the latch or lock feature would often not be clear to either the controller 14 or the user and this caused a degree of frustration. By providing the dual sensor/switch combination the user controls the action of the input to insure grasping the handle 16 and therefore activating the sensor 28 alone will not unlatch the door unless the user 26 simultaneously touches the second sensor or switch 29. The ergonomics of the present invention is remarkably convenient and the normal access door opening has the hand cup shape with the fingers grasping the handle along an interior surface which is where the sensor or switch 28 is conveniently positioned. Similarly the thumb is normally positioned on the outside of the handle 16, therefore, the second sensor or switch 29 being located on the outside surface of the handle 16 insures that the normal grasping of the handle by an authorized user will always unlatch the door. A second feature of the present invention is the activation of the second sensor or switch 29 can be used as a locking feature, locking that access door or if so programmed can lock all access doors. This is particularly handy in vehicles wherein "keys or fob" are no longer needed such as in passive entry systems. To even further simplify the design the handle 16 can have an optional additional sensor 29 (shown in dashed lines) positioned on an opposite end of the handle 16 wherein regardless of which hand 2 the user 26 grasps the handle 16 with, interaction of both the fingers on sensor 28 and one of the sensors 29 will cause the door to unlatch.

The handle 16 can also take on any number of different shapes, sizes and designs. It can be formed as a depression or bump in a door or access surface with a sensor packaged in or about the area where the handle would normally be placed to pull the door open. However, the invention is not so limited, and the handle can also be used in connection with a side door handle, sliding door handle, liftgate handle, tailgate handle and/or can be packaged on a decorative badge or emblem such that the operator can simply simultaneously activate or touch the emblem having two sensors or switches 28, 29 and the associated door, trunk, or other access panel will open/unlatch.

The sensors or switches 28, 29 included in the various embodiments of handle 16 may be any conventional proximity sensor, such as a magnetic, capacitive, inductive, or acoustic sensor, which undergoes a change in electronic status in response to the presence of an object in an electric field. The sensor may be an off-the-shelf type sensor that can be adjusted or "tuned" as necessary or desired for specific applications. For instance, the sensitivity of the sensor can generally be modified or adjusted to meet a given user's preferences or an application's requirements. The sensors or switches 28, 29 can also include a wire/connector or some type of contact point that communicates with controller 14 or directly to the latch mechanism 18. If desired, the sensors can also include additional electronic features to match the associated system, e.g., vehicle system requirements. Alternatively, one or both of the sensors or switches 28, 29 may be mechanical switches.

Figure 3:
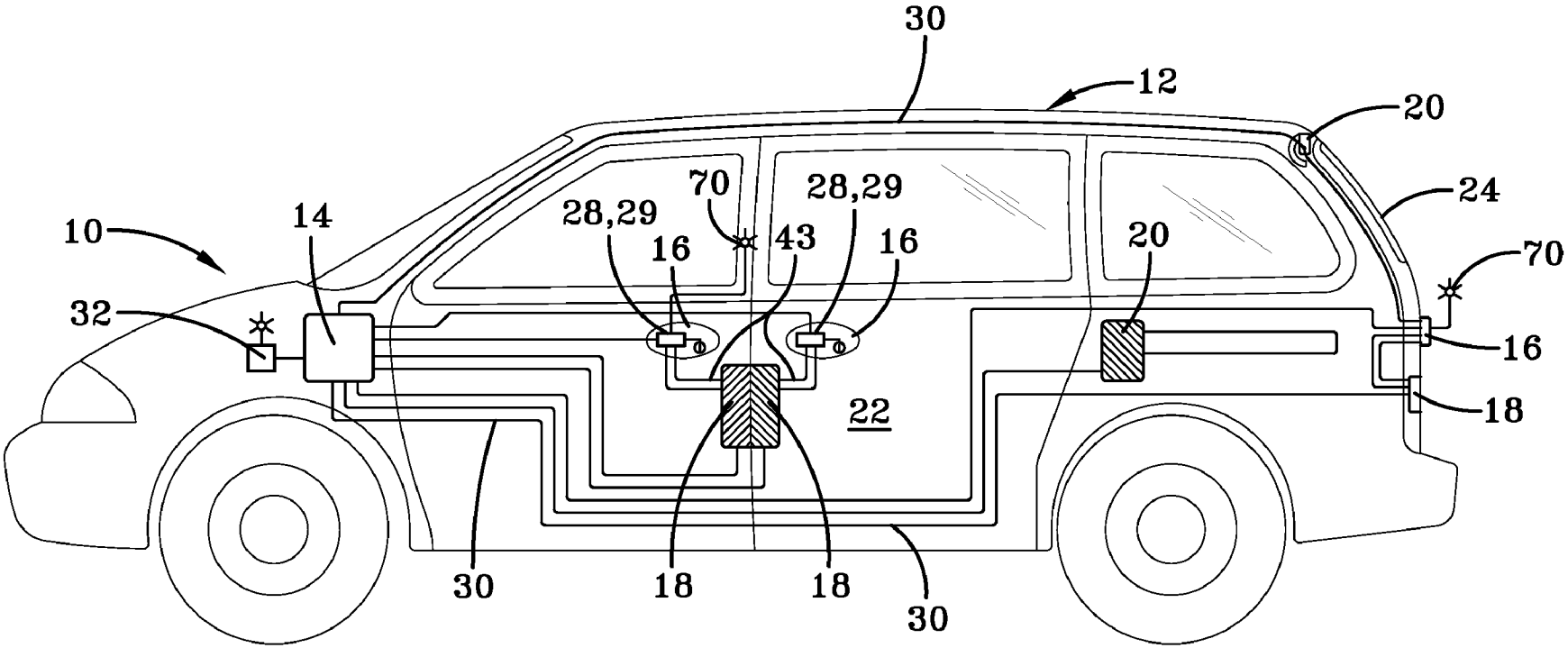
FIG. 3 is schematic of a side view of the vehicle of FIG. 1, showing an exemplary control circuit according to another embodiment of the present invention

One form of sensor that may be used with the system is an electro-capacitive sensor, such as an electro-capacitive sensor marketed by Nippon Aleph. Among other features, electro-capacitive sensors offer a wide range of supply voltages (e.g., from about 5 to about 72 volts), operate at temperatures down to −40 degrees or lower, and operate on a relatively low standby current (less than 1 mA). Electro-capacitive sensors also exhibit a relatively fast response time (a max of about 100 msec), which enables the system to operate in a stand-by mode and selectively "switched-on" when needed. Electro-capacitive sensors may be generally shock and vibration resistant and operate through cloth and other materials (e.g., gloves). Electro-capacitive sensors are typically logic-ready or workable in the context of multiplex output. If desired, electro-capacitive sensors can be used in a system that will operate only when a hand approaches a door handle, for example, but without limitation, minimum contact area of 0.3 sq. in., which is approximately equal to the horizontal width of two adult fingers, with a detecting range distance of from about 0.1 to 1.2 inches. Because sensors 28, 29 may be capacitive in nature, a circuit is closed (if power is supplied to it) when a user touches, approaches or otherwise interacts with handle 16. The output from sensor 18 may be hard wired, as shown in FIGS. 2 and 3, or may be provided to controller 14 or latch mechanism 18 wirelessly using a suitable wireless connectivity protocol.

Another sensor that may be used in connection with the system 10 is a field effect sensor, such as the TS-100 sensor marketed by Touchsensor Technologies LLC. Among other features, field effect sensors generally produce a relatively strong signal, have a relatively high immunity to electrical noise and contaminants, can work through various substrates, like plastic, glass and leather, and do not require software to operate. Unlike an electro-capacitive sensor, field effect sensors include a digital input/output at the point of touch, eliminating software (microprocessor) to interpret the analog signals found in electro-capacitive sensors. In operation, when a minimal voltage, e.g. 5 volts, is applied to a field effect sensor, an electric field 60 (represented generically in FIG. 4) is created around at least a portion of the sensor. The field emanates through any dielectric substrate, such as the handle material. When a conductive mass enters the field, the sensor detects the change and indicates an event has occurred. The input stimulus to the field can take many forms, including a human finger or hand 2, for example.

Because sensors 28, 29 may be integrated into or provided on an external vehicle component, such as an exterior door handle, external effects may lead to sensors 28, 29 operating unintentionally, for example by the influence of rain, snow and ice. To prevent unintentional operation, controller 14 and/or sensor 28 may be configured to "switch" only when a change in a property of the sensor field is greater than a predetermined threshold value, or the rate of change in a property of the sensor field exceeds a threshold value. By having two sensors or switches 28, 29 the redundancy greatly reduces inadvertent or unintentional unlatch signals due to the requirement that both sensors or switches must be activated simultaneously.

In another embodiment, system 10 can be configured to limit the power application to a specific time to better protect the electronically activated components from damage. In a particular configuration, controller 14 senses or knows when the electronically activated latch mechanism 18 is in the open position so that the door closes when a user's hand is on or in a predetermined proximity of handle 16. For example, if a user is holding the door open for someone and then closes the door, all the while holding onto handle 16, controller 14 can be designed to know or recognize that the subject door is unlatched and there is no need for the controller to supply power to the latch mechanism 18 that is already open. In addition, when a user closes a door, the user would not typically want the latch mechanism 18 to stop the user from closing the door. The system 10 can be designed to prevent such an occurrence. Such optional types of customization can permit the system 10 to work in a wide range of fields and applications, e.g., across a number of different vehicle platforms. To achieve such flexibility is only a matter of general vehicle electronics (e.g., the present invention can make use of electronics associated with the "door ajar" signal already in a vehicle system to tell the controller to stop sending power to the electronically activated latch mechanism 18 and/or sensor 28. It should also be noted that, if desired, system 10 can be designed so that a user does not need to physically touch handle 16. In short, in some embodiments the sensor 28 can be adjusted or tuned to function as a proximity sensor.

In another embodiment, the function of a traditional lock/unlock device can be replaced by system 10. In such circumstances, the lock/unlock device is not required because when a vehicle is locked, the controller 14 does not supply power to sensor 28, thus making it inactive and thereby "locking" the door. Further, in such circumstances, there would be no "thunk" or other mechanical noise when the lock button is depressed because there would not be any associated moving pieces on the vehicle for lock and unlock. If the lack of such noises poses a concern to a user (e.g., not knowing if the button actually worked), this can be addressed by other audio or visual signals, such as having the horn sound or the lights blink on and off. It is also possible to have the vehicle display a lock/unlock light on the dashboard or even provide a recorded voice acknowledging that the user has indeed locked or unlocked the door or panel.

In some vehicle applications, when a vehicle is put in drive or reaches a minimum speed, controller 14 can be programmed or set to shut power off to sensors, effectively automatically locking a door when the vehicle is in operation. Such a feature would be somewhat similar in operational results to conventional systems in the market; however, the present invention does not require all of the moving parts that a conventional system needs to accomplish a similar function. To account for conditions of power failure, the vehicle can be equipped with one or more mechanical override systems. In some circumstances, it may be desirable to utilize existing technology similar to that conventionally used with trunk lids. For instance, without limitation, a user could mechanically override the system by inserting a key into a corresponding key cylinder and may be required to turn the key. The entry or turning of the key could trip the corresponding latch and, depending upon whether it is desired, unlock the door. Some embodiments may use a cable system to transfer the motion of the key to the lever on the latch. However, this can also be achieved with a rod, which may reduce cost. There are several other ways to include conventional technology to mechanically override system 10, for example, a more traditional door handle/latch opening mechanism (e.g., FIG. 3) may be used in conjunction with the handle embodiment illustrated in FIG. 4.

Pursuant to the above described embodiments, there are a number of applications that can be contemplated in connection with the invention. Such applications, which may use all or some of the components of this invention, include, without limitation, use with sliding doors and/or liftgates, including those with automatic doors. If desired, the system could be designed so there is no need for a pull handle, e.g., the door could include a pair of spaced-apart sensors positioned or packaged at virtually any convenient (or inconvenient) location. An operator could simply simultaneously touch the pair of sensors and the door would unlatch and open.

By including such sensors in handles 16, such as those used on a vehicle to open an access door, such as the vehicle cabin and/or trunk, can provide a number of benefits including, without limitation, a reduction in the number of moving parts in a vehicle door, the elimination of pinch points in (e.g., between a handle hinge) and/or improved sealability (the handles 16 of the invention can be sealed at the attachment points to be essentially airtight and watertight). The handles 16 of the present invention may also reduce or eliminate noises (such as wind noise) from entering the vehicle. Because the handles 16 can be non-movably secured to the vehicle, the handles provide a more robust feel without the squeaks and or rattles associated with more traditional movable vehicle handles. This feature can also eliminate various conventional door handle components, including without limitation, rivets, bumpers, springs, bellcranks, rods, clips, counterbalances, gaskets, sleeves, keycaps, pivot brackets, and grease, which may result in a weight reduction and cost savings.

Figure 5:
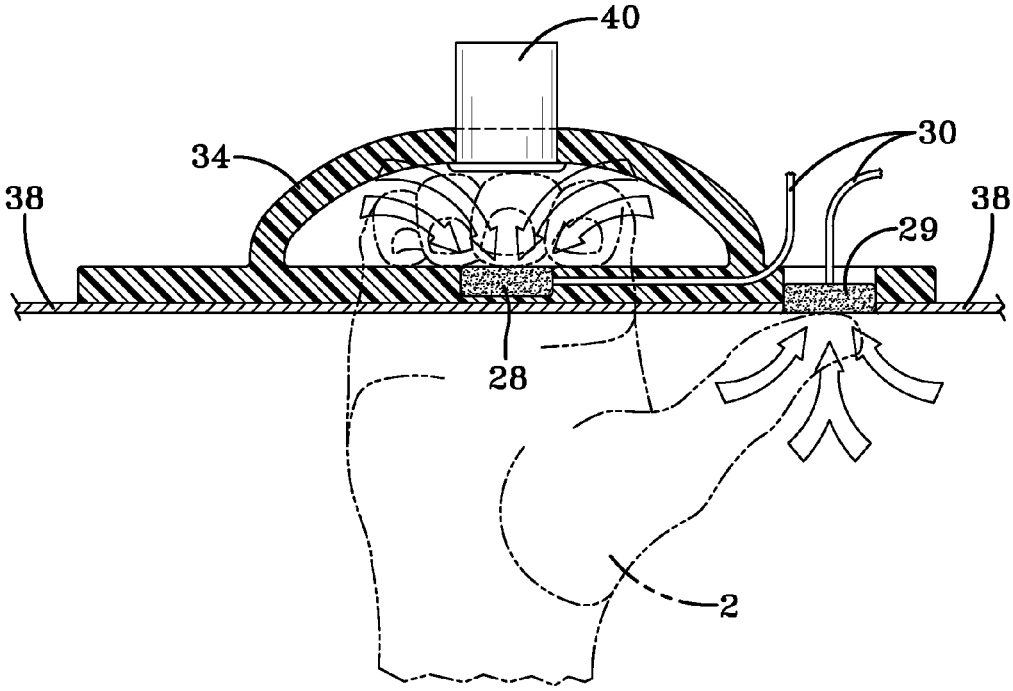
FIG. 5 is a cross-sectional view of a built-in handle according to another embodiment of the invention.
Figure 6:
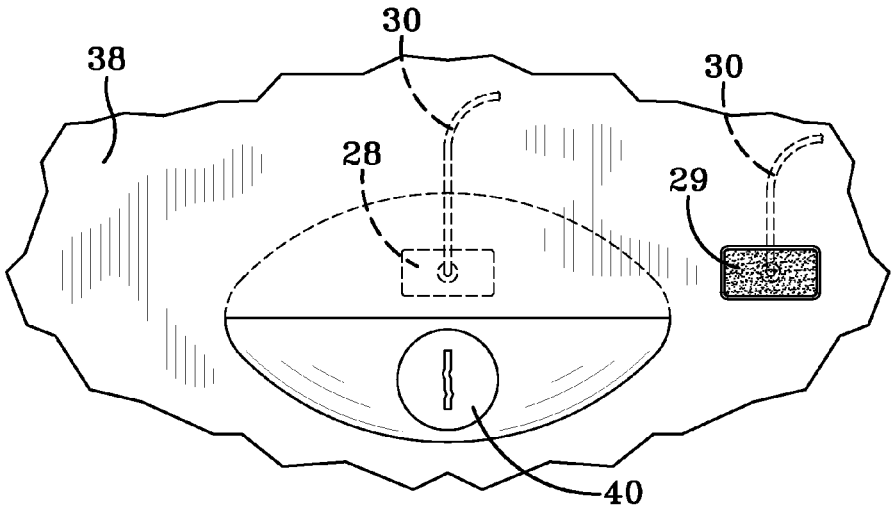
FIG. 6 is a view of the built-in handle of FIG. 5 flush mounted inside of the access door and formed as a depression in the door.

As shown in FIGS. 5 and 6, from a styling point of view the handle 16 can be a smooth part of the door's exterior surface having a recess into which the users hand can grasp to open the access door. As such the vehicle would have an appearance of no handles 16 with the sensor or switch 28 on the inside surface and the sensor or switch 29 activated by touch on the outer surface. As shown, the key cylinder 40 is embedded in the depression formed in the handle 16.

System 10 may, if desired, be designed to function with "active" and "passive" entry features. When a vehicle (such as vehicle 12) is equipped with "active entry" features, an additional act is required on the user's part before unlatching occurs (so that the mere presence of the driver is not enough to unlatch the doors). In a representative embodiment, system 10 permits a user 26 to unlock the vehicle by pressing a button on a conventional "active entry" type key fob. The access doors remain latched, but are unlatched when the user signals an intention to open an access door, such as by touching or otherwise interacting with a handle 16, which includes sensors or switches 28, 29 contained therein that activates the unlatching mechanism 18 associated with the corresponding access door. Following unlatching, the user is able to pull on the handle 16 to open the access door in a conventional manner, or pull on the access door itself when the handle 16 does not include a pull bar (e.g. when the handle 16 is an emblem).

"Authorization" for entry into the vehicle may be based upon the signal from the key fob or other form of signal/ confirmation. For example, pressing a button on the fob may effectively "unlock" the door (as opposed to "unlatching" the door, which is subsequently accomplished by interacting with handle 16 and activating sensors or switches 28, 29). The controller 14 will allow power to reach the corresponding electronically activated latch mechanism 18 if sensors 28, 29 are "on" and activated by the user. To save battery power, system 10 may be configured to automatically power down during periods of non-use. However, because of the relatively low drain of power from the electrical system associated with the operation of the sensors (as low or lower than 15 microamps), the controller 14 may provide power to the sensor 28 all of the time and controller 14 will send power to unlatch the access door or not, depending on whether or not the car is locked or unlocked (e.g., as controlled by the key fob). Alternatively, controller 14 can be configured to send power to sensors 28, 29 only when the car is unlocked and the power could be shut off when the car is locked.

The system may, if desired, also include passive entry features. When a vehicle (such as vehicle 12) is equipped with "passive entry" features, the user 26 can simply walk up to vehicle 12 and the system 10 will turn on automatically. In an embodiment of the invention shown in FIG. 3, a transmitter/receiver antenna 70 is positioned within or embedded in handle 16 along with sensor 28. When activated, antenna 70 sends out a signal looking for an associated response (presumably from a permitted user device, such as an electronic key). Providing an antenna 70 in the handle allows a relatively low power signal to be issued by system 10, thus saving battery power. Alternatively wireless transmitter/receiver 32 may be used alone or in combination with antenna 70 to provide a separate, possibly stronger signal, to extend the reach of the inquiry zone.

In one configuration, when the device or "key" is detected, system 10 is activated and power is supplied to sensors 28, 29. When the user touches (or otherwise activates) handle 16, by simultaneously touching or interacting with the sensors or switches 28, 29 these sensors sense the user (e.g. the user's hand) and effectively "unlocks" the vehicle, such as by permitting use of latch mechanisms 18. The user simply pulls on the handle while activating both sensors which mechanically triggers the door latch mechanism 18.

In another configuration, when the device or "key" is detected, the system 10 is activated and power is supplied to sensor 28. When the user touches (or otherwise activates) handle 16, the sensors or switches 28, 29 senses the user and unlatches the corresponding access door. As noted above, a mechanical override system can be included in case of vehicle power failure. Also, if desired, the "key" (fob) and the lock/unlock button could always permit a user to override system 10 or the sensors 28 and 29.

While specific preferred embodiments and materials have been illustrated, described and identified, it is to be understood that the invention is in no way limited thereto since modifications may be made and other embodiments of the invention will occur to those of skill in the art to which this invention pertains. Thus, it is intended to cover any such modifications and other embodiments as incorporated the features of this invention within the full lawful scope of the allowed claims as follows.

We claim:

1. A handle for use in a vehicle to authorize a mechanism to unlatch an access door comprising:

a structural part;

a cover; and a pair of sensors or switches between said structural part and said cover, a first sensor or switch to interact with one or more digits of a user's hand and a second sensor or switch spaced from said first sensor to be activated by another digit including the user's thumb, the combination of the two switches or sensors operatively signal the mechanism to unlatch the access door.

2. The handle of claim 1 wherein the activation of only the second sensor or switch in the absence of activating the first sensor or switch authorizes a mechanism to lock the access door.

3. The handle of claim 1 wherein the structural part is formed as a bump or depression in an exterior surface of the access door.

4. The handle of claim 1 wherein at least the structural part is rigid and non-moveable.

5. The handle of claim 4 wherein the handle is rigidly and non-moveably attached or otherwise secured to the access door.

6. The handle of claim 4 wherein the access door is one or more of a hinged door, a sliding door, a lift hatch, a tailgate, a trunk lid or a bonnet or hood of a vehicle.

7. The handle of claim 1 wherein either the handle or the access door on which the handle is formed or otherwise attached includes a key cylinder and mechanical opening latch to permit the access door to be opened overriding the sensors or switches in the event of a power failure.

8. The handle of claim 1 includes a housing portion and a pull bar portion, the first sensor positioned in said housing portion.

9. The handle of claim 1 wherein at least the first sensor or switch is an electro capacitive sensor.

10. The handle of claim 9 wherein the second sensor or switch is a push activated switch device.

11. The handle of claim 9 wherein the first and second sensors or switches are electrically coupled, the activation of both authorizes an unlatching, the activation of only the second sensor or switch authorizes a lock only feature, the second sensor or switch changes authorization from unlatch to lock dependent on the use or non-use of the first sensor or switch.

* * * * *